US007305862B2

(12) United States Patent
Heavens et al.

(10) Patent No.: US 7,305,862 B2
(45) Date of Patent: Dec. 11, 2007

(54) CRACK TESTER FOR FLARED ENDS

(75) Inventors: Glenn G. Heavens, Cheshire, CT (US); James D. Jones, Jr., Barrington, IL (US)

(73) Assignee: Illinois Tool Works Inc, Glenview, IL (US)

( * ) Notice: Subject to any disclaimer, the term of this patent is extended or adjusted under 35 U.S.C. 154(b) by 83 days.

(21) Appl. No.: 11/228,677

(22) Filed: Sep. 16, 2005

(65) Prior Publication Data

US 2007/0062235 A1 Mar. 22, 2007

(51) Int. Cl.
*B21D 39/20* (2006.01)

(52) U.S. Cl. ..... 72/370.06; 72/4; 72/17.3; 72/370.11

(58) Field of Classification Search ..... 72/4, 72/3, 17.3, 19.4, 19.6, 31.06, 31.01, 31.08, 72/370.1, 370.11, 370.06; 73/832, 834
See application file for complete search history.

(56) References Cited

U.S. PATENT DOCUMENTS

| | | | | |
|---|---|---|---|---|
| 3,412,592 | A * | 11/1968 | Ramsay | 72/316 |
| 4,308,736 | A * | 1/1982 | Lowe et al. | 72/31.06 |
| 4,590,785 | A * | 5/1986 | Morris | 72/392 |
| 6,382,008 | B1 * | 5/2002 | Jaubert | 72/21.4 |

FOREIGN PATENT DOCUMENTS

JP 09026386 A * 1/1997

* cited by examiner

*Primary Examiner*—Derris H. Banks
*Assistant Examiner*—Debra M Wolfe
(74) *Attorney, Agent, or Firm*—Mark W. Croll; Paul F. Donovan

(57) ABSTRACT

A crack test for a tubular structure includes a sensor ring disposed radially outward from a flare pin in a flaring press. The sensor ring is responsive to physical contact from a cracked flared end of a tube processed in the press.

14 Claims, 2 Drawing Sheets

CRACK TESTER FOR FLARED ENDS

FIELD OF THE INVENTION

The present invention relates to stamped parts and components, particularly expanded portions of such parts or components, such as flared ends on tubes; and, more particularly, the invention pertains to devices and tests to identify flawed parts having cracked expanded portions.

BACKGROUND OF THE INVENTION

Stampings and progressive stampings are used to manufacture parts and pieces of many different types and shapes for use in a variety of different assemblies and constructions. Metal can be shaped into many different forms and configurations by the application of force causing a metal blank to conform to the shape of a die used while applying the force. Simple parts and pieces can be made by a single stamping. In a single stamping, force is applied in a single event so that the metal conforms to a die used while applying the force. For more complex parts or parts taking a shape quite different from the original metal blank, progressive stampings are used. In progressive stampings, a series of dies are used in a series of stamping events, with each die and each stamping event forming the metal in stages from the original blank to the desired final formation.

It is known to use stamping techniques to form a variety of parts having an expanded area or flare at an end thereof. For example, a substantially cylindrical or tubular part can be stamped to have an outwardly bulged or flared portion at one end thereof. The initial flaring process can be a precursor, or preliminary step to a subsequent operation. By way of example, it is known to flare a tube end and then compress the flared portion in a folding manner onto itself to produce a two layer thick foot or flange at the end of tube.

Stamping is often used to make parts and pieces inexpensively, since a stamping event is a rapid occurrence. Accordingly, parts can be formed quickly and inexpensively, with minimal waste. To ensure a high percentage of quality parts are shipped to customers cost effectively, testing procedures for stamped parts must be performed rapidly and reliably. Preferably, a testing method occurs quickly so that testing or inspection of the part does not slow the overall process of making the part.

When forming expanded portions of stamped components, such as flared ends on tubes or pipes, the material in the portion being expanded or flared can crack. It is important to identify cracked parts as the crack can cause leakage if the part is configured for conducting fluid flow therethrough, and a crack in the part can propagate, leading to premature failure of the finished part. A cracked flared end formed in a preliminary step, in anticipation of forming a folded flange as described previously, can lead to a defective finished part. If load-bearing, the part may be inadequate causing a joint to fail due to providing insufficient bearing area for an installed assembly causing loss of clamp load. The part also can be mal-formed if cracks are present from earlier steps.

Detecting a flaw such as a crack can be difficult. Known stamping defect detection systems evaluate changes in forming pressure to detect defects. Small cracks may not be sufficient for detection at the time; however, due to propagation small cracks may be significant later. After the part is completed defect detection also may be difficult. For example, on a part having a folded flange or foot that looks acceptable, the crack or cracks may be hidden beneath the folded material and therefore difficult to detect after the part is completed.

It is desirable to identify parts in which defects have occurred so that the defective part is not shipped together with acceptable parts. Since many parts made by stamping that include expanded or flared components are produced quite rapidly at low cost, it is desirable that any apparatus and process for identifying cracked parts or components work equally fast so as not to slow the manufacturing process, or add undue cost to the final price of the part being produced.

What is needed in the art is a crack testing apparatus that quickly and accurately identifies cracked parts such as a crack in a flared end of a tube, pipe or the like.

SUMMARY OF THE INVENTION

The present invention provides a testing device incorporated directly with the stamping press for identifying flared parts or components that crack during the flaring process.

In one aspect thereof, the present invention provides a flaring press with a flare pin having a contoured end for entering a tube end and modifying a shape of the tube end, and a sensor means disposed radially outward and spaced from the contoured end. The sensor means is configured and arranged for providing a signal in response to cracks disposed in the tube end. A response means is responsive to a signal from the sensor means In another aspect thereof, the present invention provides a flaring press with a die case and a flare pin retained in the die case. The flare pin has a contoured end for receiving a tube end thereon and for modifying a profile of the tube end. A sensor means is disposed radially outward and spaced from at least a portion of the contoured end. A response means is operated by signals generated from the sensor means.

In a still further aspect thereof, the present invention provides a process for determining cracks in a tube-like body, with steps of expanding a portion of the tube-like part; determining excessive outward expansion of the expanded portion; and rejecting the part based on the finding of excessive outward expansion.

An advantage of the present invention is providing a device that determines or identifies cracked components so that the cracked component can be discarded.

Another advantage of the present invention is providing a device for identifying cracked material on flared ends of tubes or the like.

Still another advantage of the present invention is providing a crack identifying system incorporated directly with a press creating a flared end, so that a flawed part can be identified immediately and quickly.

Still another advantage of the present invention is providing a crack detecting device for flared ends that operates in conjunction with the flaring process so that no additional time is required for testing the flared end and the manufacturing speed is not slowed.

Other features and advantages of the invention will become apparent to those skilled in the art upon review of the following detailed description, claims and drawings in which like numerals are used to designate like features.

Figure 1:
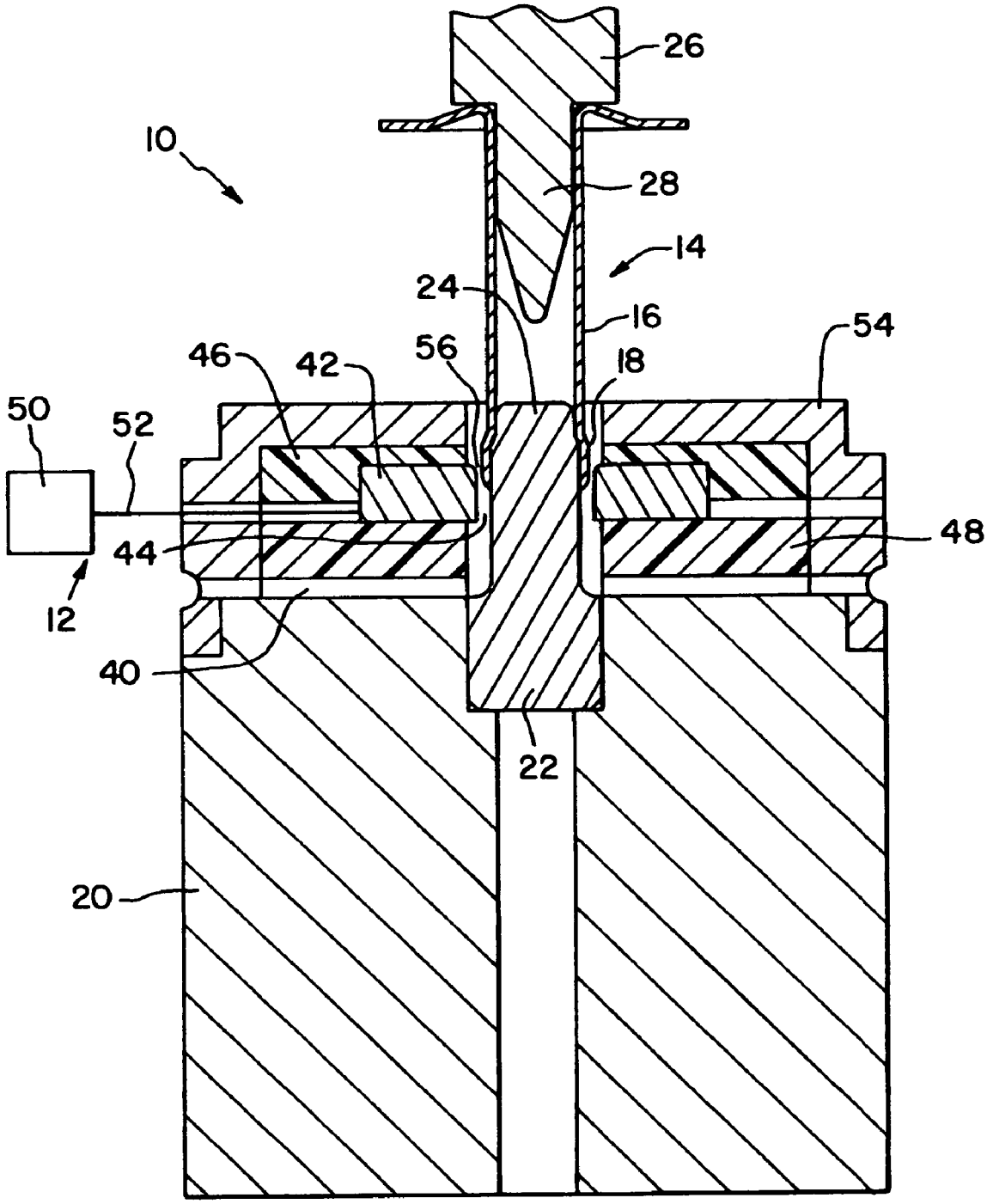
FIG. 1 is a cross-sectional view of a stamping press for flaring a tube end, the press having a test system in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, a flaring press 10 having a crack test system 12 in accordance with the present invention is shown. Press 10 is configured for producing a production part 14 having a tubular segment 16 on which a flared end 18 is formed by press 10. Crack test system 12 is provided for identifying production parts 14 in which cracks are formed as flared end 18 is created.

It should be understood that the present invention is not limited to a press for producing a production part exactly as that shown and described herein. Production part 14 is merely an illustrative example of a part for which the present invention can be used. The present invention has applicability for detecting cracks in other expanded or flared components of other parts.

Flaring press 10 includes a flare die case 20 retaining a flare pin 22 therein. Flare pin 22 includes a contoured distal end 24 for receiving tubular segment 16 thereon. As relative axial movement occurs between flare pin 22 and tubular segment 16, by movement of one or the other towards the other, or movement of each toward the other, contoured distal end 24 modifies the profile of tubular segment 16, thereby forming flared end 18. A quill assembly 26 having a probe or punch 28 for entering, centering, aligning and pushing part 14 can be used. The general construction of a flaring press and the manner of operating the same to flare a tube are well known to those skilled in the art and will not be described in further detail herein.

It should be understood that flare press 10 might be only one step in a progressive process for generating a significant modification in the shape of a part produced thereon. For example, flared end 18 can be a preliminary stage in the production of a substantially flat annular foot or flange formed by folding or compressing flared end 18 on itself. The present invention can be used at one, several or all steps of a progressive process to identify parts in which cracks are formed.

Crack test system 12 is provided in a cavity 40 surrounding the distal end of flare pin 22. A sensor ring 42 is provided to determine cracks in flared end 18, and in the exemplary embodiment comprises a continuous ring 42 surrounding contoured distal end 24. Sensor ring 42 is in spaced relationship to flare pin 22 and defines a gap 44 that is only minimally larger than the thickness of production part 14 in the segment thereof that is inserted over flare pin 22. A top shield 46 and a bottom shield 48 are provided on opposite sides of sensor ring 42 and are continuous rings covering and shielding sensor ring 42 on opposite sides.

Sensor ring 42 is connected to a response means 50 via a signal line 52. Response means 50 can be of a variety of types of indicators, warnings or automatic response sequences, including, for example, an indicator light, audible alarm, automatic shutoff of press 10 or other suitable means for alerting an operator of the failed condition of a production part 14 being produced or for automatically identifying and handling the failed part.

Sensor ring 42, top shield 46 and bottom shield 48 are secured against flair die case 20 by a flare die cover 54 with appropriate fasteners or fixtures (not shown).

In the exemplary embodiment, sensor ring 42 is a ground sensor configured for determining contact with production part 14. As illustrated in FIG. 1, if an acceptable flared end 18 is formed a reduced gap 56 remains between the material of flared end 18 and sensor ring 42 when part 14 is disposed on distal end 24 of flare pin 22. No portion of part 14 contacts sensor ring 42. The ground the circuit is not complete. Acceptable part 14 can be extracted from press 10 and transferred to subsequent process steps.

Figure 2:
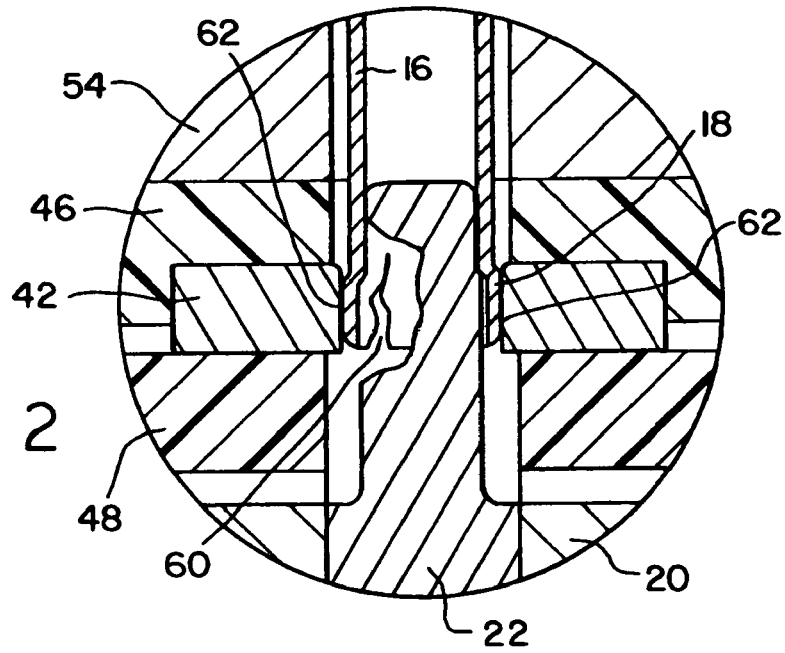
FIG. 2 is an enlarged fragmentary cross-sectional view of a portion of the press shown in FIG. 1 and illustrating a cracked flared end on a tube in the press.
Figure 3:
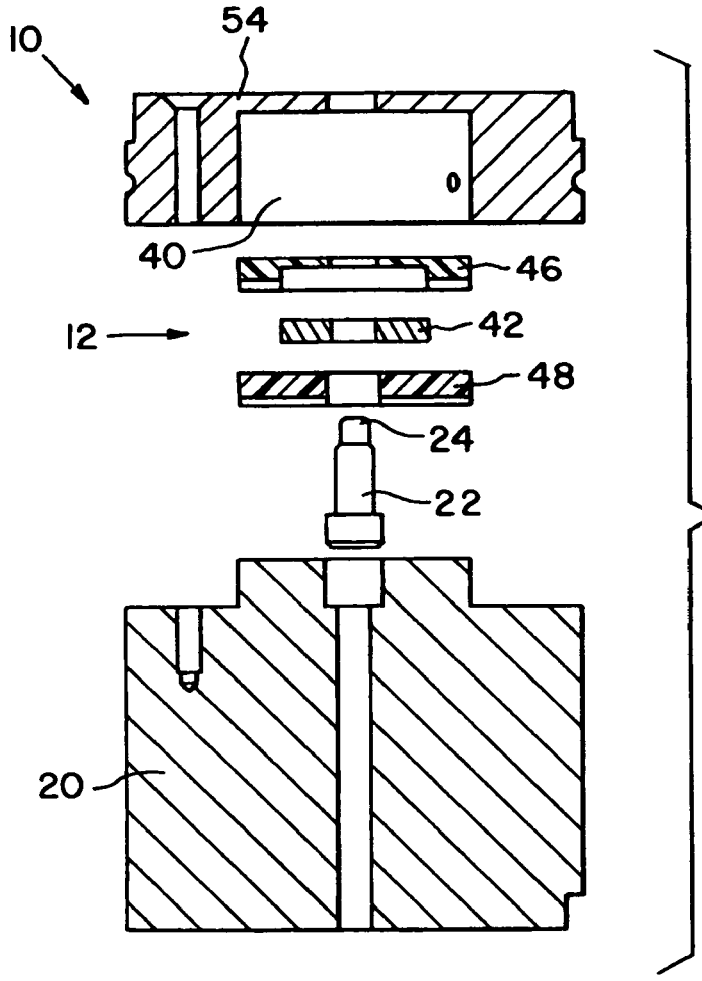
FIG. 3 is an exploded view of the stamping press.

In the event that a crack 60 is formed as flared end 18 is formed, the material of tubular segment 16 expands radially outward beyond the expansion of an intact flared end. As illustrated in FIG. 2, the outwardly expanded material contacts sensor ring 42 at one or more contact points 62. Two contact points 62 are shown in FIG. 2; however, it should be understood that a defective part may contact sensor ring 42 only at a single point or may cause a substantially continuous contact throughout and along sensor ring 42. A variable, adjustable resistor can be used to filter out false reject signals caused by minor metal chips or debris in press 10.

A signal is transmitted to response means 50 so that an appropriate alarm is generated, alerting an operator to remove and discard defective production part 14. Alternatively, as described previously, in an automated system response means 50 can be adapted and configured for automatic separation and handling of the defective production part 14 as production continues on press 10. As yet another alternative, response means 50 can flag or otherwise designate a defective part 14 for later separation and handling.

While sensor ring 42 has been illustrated and described as a continuous body surrounding flare pin 22, it should be understood that multiple, relatively closely spaced sensors can be used responsive to physical contact from material of production part 14. Alternatively, optical sensors and/or other sensing means can be used to evaluate the condition of flared end 18 in other ways and to generate the appropriate signal to and response by response means 50 when a flared end exhibiting excessive outward expansion is detected.

Crack test system 12 works in conjunction with and simultaneously as press 10 operates to form flared end 18 on production part 14. Consequently, no additional time is required to perform the crack test on part 14 in that the test occurs simultaneously with formation of flared end 18. No additional steps are required in the manufacturing process for performing testing and no additional production space is required for a test stand.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A flaring press comprising:

a flare pin having a contoured end for entering a tube end and modifying a shape of the tube end;

sensor means disposed radially outward and spaced from said contoured end, said sensor means configured and arranged for providing a signal in response to cracks disposed in the tube end; and response means responsive to a signal from said sensor means; wherein said sensor means comprising a ring encircling said contoured end.

2. The flaring press of claim 1, said sensor means configured to respond to physical contact with a cracked tube on said flare pin.

3. The flaring press of claim 2, said sensor means comprising a ring encircling said contoured end.

4. The flaring press of claim 1, said sensor means being a ground sensor.

5. A flaring press comprising:

a die case;

a flare pin retained in said die case, said flare pin having a contoured end for receiving a tube end thereon and for modifying a profile of the tube end;

a sensor means disposed radially outward and spaced from at least a portion of said contoured end; and response means operated by signals generated from said sensor means; wherein said sensor means comprising a ring encircling said at least a portion of said contoured end.

6. The flaring press of claim 5, said sensor means configured and arranged to respond to physical contact with a cracked tube on said flare to remain spaced from an intact tube on said flare pin.

7. The flaring press of claim 6, said sensor means comprising a ring encircling said contoured end.

8. The flaring press of claim 7, including a flare die cover, and said sensor means disposed between said flare die cover and said die case.

9. The flaring press of claim 8, including shields on opposite sides of said sensor means.

10. The flaring press of claim 5, said sensor means being a ground sensor.

11. The flaring press of claim 10, said ground sensor configured and arranged to respond to be contacted by a cracked tube on said flare pin and to remain spaced from an intact tube on said flare pin.

12. A process for determining cracks in a tubular shaped body, said process comprising steps of:

expanding a portion of the tubular shaped body;

determining excessive outward expansion of the expanded portion, said determining performed by annular sensor sensing a radial position of the expanded part; and rejecting the part based on the finding of excessive outward expansion, wherein said steps of expanding and determining are performed simultaneously, and wherein said sensing step is performed by sensing physical contact with a portion of a part having excessive outward expansion.

13. A process for determining cracks in a tubular shaped body, said process comprising steps of:

expanding a portion of the tubular shaped body part;

determining excessive outward expansion of the expanded portion; and rejecting the part based on the finding of excessive outward expansion, said step of determining excessive outward expansion performed by sensing physical contact with a portion of a part having excessive outward expansion.

14. The process of claim 13, wherein said steps of expanding and determining are performed simultaneously.

* * * * *